US007632161B1

(12) United States Patent
Waldvogel et al.

(10) Patent No.: US 7,632,161 B1
(45) Date of Patent: Dec. 15, 2009

(54) MARINE TRANSMISSION ACTUATOR

(75) Inventors: David J. Waldvogel, Fond du Lac, WI (US); Steven J. Amerling, Fond du Lac, WI (US); Darin C. Uppgard, Oshkosh, WI (US); Randall J. Poirier, Howards Grove, WI (US)

(73) Assignee: Brunswick Corporation, Lake Forest, IL (US)

( * ) Notice: Subject to any disclaimer, the term of this patent is extended or adjusted under 35 U.S.C. 154(b) by 169 days.

(21) Appl. No.: 11/899,305

(22) Filed: Sep. 5, 2007

(51) Int. Cl.
*B63H 23/00* (2006.01)

(52) U.S. Cl. ..... 440/75

(58) Field of Classification Search ..... 440/75
See application file for complete search history.

(56) References Cited

U.S. PATENT DOCUMENTS 1,657,841 A * 1/1928 Peris ..... 251/283
3,623,583 A 11/1971 Shimanckes ..... 192/51
3,858,101 A 12/1974 Schmiedel et al. ..... 318/448
5,301,922 A 4/1994 Hayasaka ..... 251/283
5,328,396 A 7/1994 Hayasaka ..... 440/86
6,470,913 B1 * 10/2002 Woodworth ..... 137/625.23
2006/0073747 A1 4/2006 Harada et al. ..... 440/75
2006/0157316 A1 7/2006 Okanishi et al. ..... 192/221

OTHER PUBLICATIONS

U.S. Appl. No. 11/786,821, filed Apr. 13, 2007, Phillips et al.

* cited by examiner

*Primary Examiner*—Stephen Avila
(74) *Attorney, Agent, or Firm*—William D. Lanyi

(57) ABSTRACT

A hydraulic valve, such as a rotary valve, is connected in fluid communication with a hydraulic actuator that, in turn, causes a clutch to move between forward, neutral, and reverse gear positions. A marine transmission is caused to shift between these gear positions in response to movement of a spool of the hydraulic valve, which can be a rotary valve. Movement of the valve causes an actuator to move to the selected gear position and maintain that gear position until a subsequent movement of the hydraulic valve.

20 Claims, 5 Drawing Sheets

MARINE TRANSMISSION ACTUATOR

BACKGROUND OF THE INVENTION

1. Field of the Invention

The present invention is generally related to a marine transmission actuator and, more particularly, to a hydraulic valve that is configured to move a hydraulic actuator into forward, neutral, and reverse gear positions and cause the actuator to remain in those positions until a subsequent change occurs with regard to the hydraulic valve.

2. Description of the Related Art

Those skilled in the art of marine propulsion devices are familiar with many different types of gear position actuators that can be used by an operator of a marine vessel to change the gear position of the marine transmission between forward, neutral, and reverse gear positions. Many of these types of transmissions are mechanical. Others use hydraulic pressure to assist in the gear shifting operation. Some systems use electromechanical components.

U.S. Pat. No. 3,623,583, which issued to Shimanckas on Nov. 30, 1971, describes an electrically operated control mechanism for a hydraulic shifting mechanism. It includes a hydraulic mechanism that is operative to effect shifting of a clutch from a fail-safe forward drive condition to either of a neutral or reverse condition. It also includes an electrically operated control mechanism for the hydraulic mechanism, which is also designed to fail-safe in forward drive. The control mechanism includes aligned, neutral and rearward drive solenoids which are selectively energizeable to afford neutral and reverse drive and which are operably associated with a single plunger carrying a spool valve embodied in the hydraulic system.

U.S. Pat. No. 3,858,101, which issued to Schmiedel et al. on Dec. 31, 1974, discloses a shift motor actuator circuit. A DC motor includes the conventional separate reverse winding and forward winding, each of which is connected individually in series with the motor armature of a battery through motor driven limit switches to stop at neutral, forward or reverse drive positions. The armature is connected to drive a valve for actuating a hydraulic shift unit. A resistor and a diode are connected in parallel between the power side of each winding and ground. The resistor acts as an electrical load and eliminates hunting of the drive system and the repeated operation of the limit switches. The resistors employed are relatively low wattage type so as to burn open in a relatively short period and without a flame or mass heat characteristic capable of igniting fuel fumes associated with recreational type marine propulsion devices. The diodes are back biased by the battery polarity but conduct transient voltages of the opposite polarity which may arise in the motor circuit.

U.S. Pat. No. 5,301,922, which issued to Hayasaka on Apr. 12, 1994, describes a changeover valve means for a hydraulic clutch of the marine propulsion unit. A drive system that includes a bevel gear forward, reverse transmission has hydraulically operated clutches. A hydraulic pump for actuating the clutches and lubricating the transmission is driven off the rear end of the input shaft and control valve means selectively communicates the fluid from the hydraulic pump with the hydraulic clutches. The valve means is a rotary plug type valve but is constructed so as to minimize axial and radial forces acting that would tend to bind its movement.

U.S. Pat. No. 5,328,396, which issued to Hayasaka on Jul. 12, 1994, describes a power transmission system for an inboard/outboard motor. A hydraulic pump for actuating clutches and for lubricating the transmission is driven off the rear end of the input shaft and control valve means selectively communicates the fluid from the hydraulic pump with the hydraulic clutches. The valve means is a rotary plug type valve but is constructed so as to minimize axial and radial forces acting that would tend to bind its movement. The construction of the outboard drive unit is such that the bevel gear transmission and hydraulically operated clutches can conveniently be inserted through like diameter oppositely facing openings formed in the upper end of the housing assembly of the outboard drive unit.

U.S. patent application Ser. No. 11/242,028, which was filed on Oct. 4, 2005 by Harada et al., describes a marine reversing gear assembly. A manual directional control valve and an electromagnetic directional control valve for a forward/reverse directional control valve for hydraulic oil supply circuit have a common structure of an oil line joint surface for the hydraulic oil supply circuit for friction discs of a forward clutch and a reverse clutch.

U.S. patent application Ser. No. 11/330,096, which was filed on Jan. 12, 2006 by Okanishi et al., describes a marine reversing gear assembly provided with a locking device. The system provides a self-contained marine reversing gear assembly provided with a locking device for internal combustion engine in which introduction of the working oil from the lubricating oil circuit is unnecessary. The marine reversing gear assembly provided with a locking device comprises an input shaft driven by an internal combustion engine, an output shaft connected to a propeller shaft, a hydraulic pump driven by the input shaft, a hydraulic forward and reverse clutch, a directional control valve for switching the forward and reverse clutch by the supply of working oil from the hydraulic pump, and a locking device provided with a locking mechanism member for locking the output shaft. The locking device comprises a hydraulic actuator for unlocking the output shaft by operating on the locking mechanism member due to the supply of working oil from the hydraulic pump.

U.S. patent application Ser. No. 11/786,821; which was filed on Apr. 13, 2007 (M10112) by Phillips et al., discloses an actuator device for a marine propulsion transmission. The actuator is attached to a movable clutch member through the use of a coupler which comprises a generally spherical member formed as a portion of the actuator and a chuck device formed as part of the clutch member. The generally spherical member, or alternatively shaped component, is received by the chuck device and retained therein. The components are configured to allow relative rotation between the actuator and the clutch member while causing them to move axially in synchrony with each other.

The patents described above are hereby expressly incorporated by reference in the description of the present invention.

In marine transmissions, it is significantly beneficial if the structure of the transmission can be simplified as much as possible while providing a generally rugged and durable structure. Hydraulically assisted gear shifting mechanisms are known to those skilled in the art. It would be significantly beneficial if a hydraulically assisted shifting mechanism could reliably move a clutch mechanism into forward, neutral, or reverse gear positions without the need for position sensing devices that detect whether or not the clutch has been moved to the proper position. In addition, it would be beneficial if such a hydraulically actuator gear shifting mechanism could be provided with a rugged and reliable hydraulic valve that moves the clutch into the proper position and maintains the clutch in that selected position until subsequent movement of the hydraulic valve which is actuated by a manually operable gear shift lever.

SUMMARY OF THE INVENTION

A marine transmission actuator made in accordance with a preferred embodiment of the present invention, comprises a clutch which is movable into forward, neutral, and reverse gear positions. It also comprises a hydraulic actuator operably connected to the clutch and configured to selectively move the clutch into the forward, neutral, and reverse gear positions. In addition, the actuator comprises a hydraulic valve having a stationary portion and a movable portion. The hydraulic valve is configured to direct hydraulic fluid between first and second cavities of the hydraulic actuator, a hydraulic pump, and a reservoir. The hydraulic valve is configured to cause the hydraulic actuator to move to a selected gear position and remain in the selected gear position until subsequent movement of the hydraulic valve.

In a preferred embodiment of the present invention, the hydraulic valve is a rotary valve and the movable portion of the valve is rotatable relative to the stationary portion of the valve. The hydraulic actuator can comprise first, second, third and fourth ports. The first and second ports are connected to first and second cavities of the hydraulic actuator, respectively, and the third and fourth ports are disposed axially between the first and second ports. In a particularly preferred embodiment of the present invention, moving the hydraulic valve to a first position connects the first and third ports to the reservoir, connects the second port to the hydraulic pump, and closes the fourth port in order to cause the hydraulic actuator to move into a forward gear position. In addition, moving the hydraulic valve to a second position which connects the second and fourth ports to the reservoir, connects the first port to the hydraulic pump, and closes the third port in order to cause the hydraulic actuator to move into the reverse gear position. The neutral gear position can comprise a first neutral gear position and a second neutral gear position in a particularly preferred embodiment of the present invention.

In a preferred embodiment of the present invention, moving the hydraulic valve to a third position which connects the third and fourth ports to the reservoir, connects the first port to the hydraulic pump, and closes the second port causes the hydraulic actuator to move into the first neutral gear position. Moving the hydraulic valve to a fourth position which connects the third and fourth ports to the reservoir, connects the second port to the hydraulic pump, and closes the first port causes the hydraulic actuator to move to the second neutral gear position. The first and second gear positions of the hydraulic actuator are axially displaced from each other and are both between the forward and reverse gear positions.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
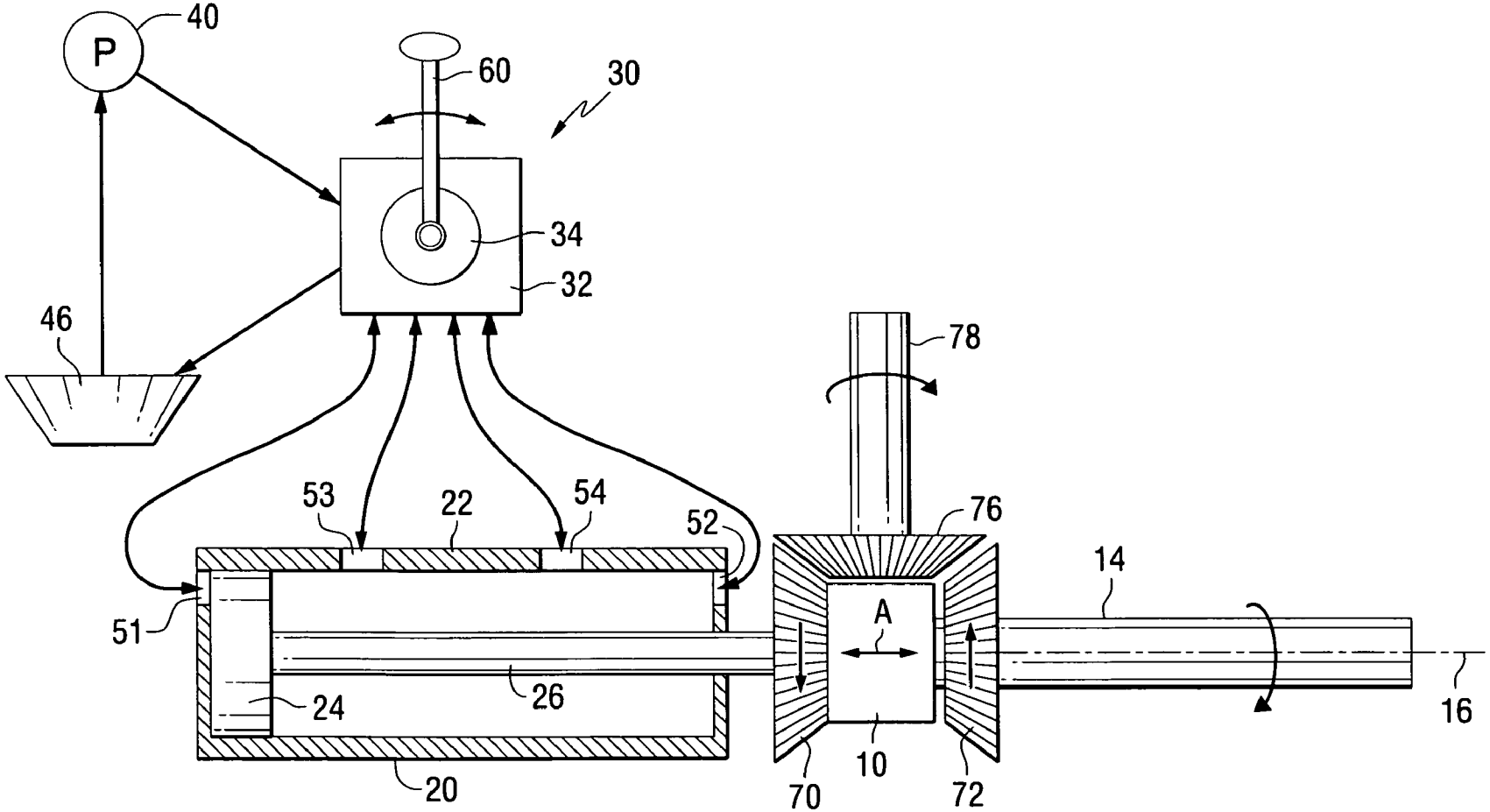
FIG. 1 is a schematic representation of a marine transmission actuator made in accordance with a preferred embodiment of the present invention.

Throughout the description of the preferred embodiment of the present invention, like components will be identified by like reference numerals.

FIG. 1 is a schematic representation of a marine transmission actuator made in accordance with a preferred embodiment of the present invention. A clutch 10 is movable into forward, neutral, and reverse gear positions. A propeller shaft 14 is supported for rotation about a rotational axis 16. The clutch 10, which can be a dog clutch, is movable in a direction parallel to the rotational axis 16 of the propeller shaft 14 into the forward, neutral, and reverse gear positions. A hydraulic actuator 20 is operatively connected to the dog clutch 10 and configured to selectively move the dog clutch into the gear positions. The hydraulic actuator 20 can comprise a cylinder 22 and a piston 24 disposed within the cylinder. A piston rod 26 is shown attached to the piston 24 and to the dog clutch 10. Movement of the piston 24 to the left or right in FIG. 1 causes a synchronous movement of the dog clutch 10. A rotary valve 30 has a stationary portion 32 and a movable portion 34. The valve is configured to direct hydraulic fluid between first and second cavities of the hydraulic actuator 20. The first and second cavities are located to the left and right of the piston 24 and within the housing structure 22. The system also provides a hydraulic pump 40 and a reservoir 46 which contains a quantity of hydraulic fluid. The hydraulic valve 30 is configured to cause the hydraulic actuator 20 to move to the selected gear position and remain in the selected gear position until subsequent movement of the rotary hydraulic valve occurs. The hydraulic actuator 20 is shown with four ports, 51-54, that are selectively connectable through the rotary valve 30 to the pump 40 or the reservoir 46. Alternatively, each of the four ports, 51-54, can be selectively closed through movement of the rotary hydraulic valve 30.

With continued reference to FIG. 1, a throttle handle 60 is shown connected to the movable portion 34 of the rotary valve. In addition, the clutch 10 is movable as represented by arrow A toward the left and right in FIG. 1 in response to movement of the piston rod 26 and piston 24 within the hydraulic actuator 20. A forward bevel gear 70 and a reverse bevel gear 72 are driven by a driveshaft bevel gear 76 that is attached to a driveshaft 78. This arrangement of bevel gears and a dog clutch 10 is generally well known to those skilled in the art of marine transmissions. Typically, bevel gears 70, 72 and 76 are in continuous meshing relation with each other and they continuously rotate about their respective axes as long as the driveshaft 78 is rotating. The clutch 10 is moved into engagement with either the forward 70 or reverse 72 bevel gear and this connects the propeller shaft 14, through a splined connection, to the driveshaft 78 with the intended direction of rotation.

FIGS. 2A-2D show the hydraulic actuator 20 in various positions which are achieved by selectively connecting the four ports, 51-54, to points of selected pressure, such as the pump P, the tank T (or reservoir) or to a blocked conduit which closes the port. For example, in FIG. 2A, the first port 51 is identified as being connected to the tank T, or reservoir 46, described above in FIG. 1. The second port 52 is identified as being connected to the pump P 40 in FIG. 1, the third port 53 is identified as being connected to the tank T, or reservoir 46, and the fourth port is identified as being closed C. This forces the piston 24 toward the left or into the forward gear position.

Figure 2A:
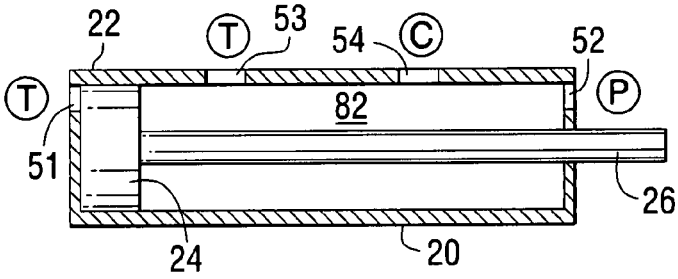
FIGS. 2A-2D show four distinct positions of an actuator resulting from movement of a hydraulic valve.
Figure 2B:
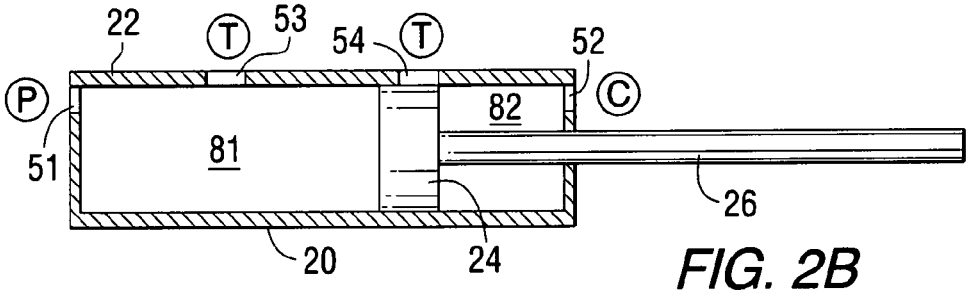
Figure 2C:
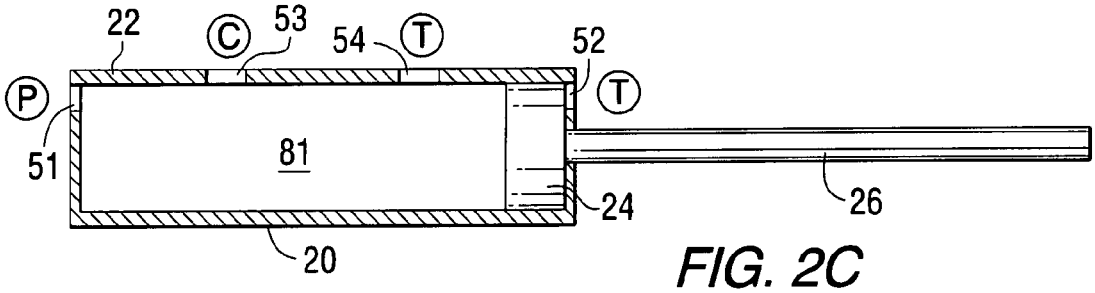
Figure 2D:
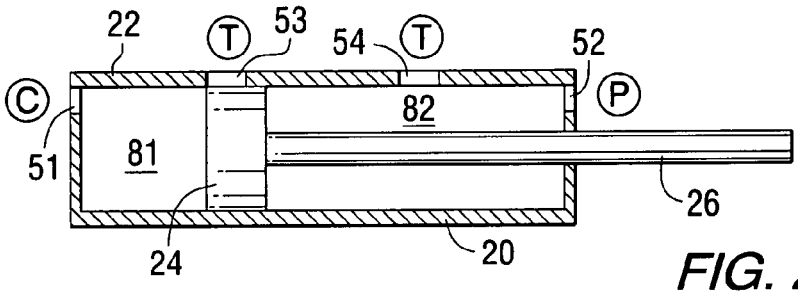

With continued reference to FIGS. 2A-2D, the first and second cavities, 81 and 82, are selectively identified in the Figures. With particular reference to FIG. 2B, if the first port 51 is connected to the pump P, the third and fourth ports, 53 and 54, are connected to the tank T or reservoir 46, and the second port 52 is closed, the piston 24 will move to the position shown. With reference to FIG. 2C, connecting the first port 51 to the pump 40, the second and fourth ports, 52 and 54, to the tank, or reservoir 46, and closing the third port 53 causes the piston 24 to move to the far right position relative to the actuator 20. This is the reverse gear position. In FIG. 2D, connecting the second port 52 to the pump 40, closing the first port 51, and connecting the third and fourth ports, 53 and 54, to the tank, or reservoir 46, causes the piston 24 to assume the position illustrated in FIG. 2D.

With continued reference to FIGS. 2A-2D, in a particularly preferred embodiment of the present invention, two neutral gear positions are used. FIG. 2B shows a forward-neutral gear position that is assumed by the piston 24 when the pressures are as shown in FIG. 2B to cause the piston to move from the forward gear position shown in FIG. 2A to the forward-neutral gear position shown in FIG. 2B. Similarly, when the pressures are as indicated in FIG. 2D, in order to move the piston 24 from the reverse gear position shown in FIG. 2C, the piston 24 moves to the position shown in FIG. 2D which is the reverse-neutral gear position. Certain advantages and simplifications can be achieved through the use of this dual neutral position procedure which, in turn, uses two ports, 53 and 54, between the first port 51 and the second port 52. It should be understood that the use of two central ports, such as the third 53 and fourth 54 ports, is not a requirement in all embodiments of the present invention. In addition, the use of two distinct neutral positions, such as those shown in FIGS. 2B and 2D, is not a requirement in all embodiments of the present invention.

With continued reference to FIGS. 1 and 2A-2D, it can be seen that movement of the throttle handle 60, which serves as the gear selector handle, causes the piston 24 of the hydraulic actuator 20 to move to specifically defined positions and remain there until the handle 60 is moved again. It is not necessary to monitor the position of the piston 24. Therefore, electrical switches are not necessary to assure that the piston 24 has moved to the proper position. In addition, no additional feedback system is required to stop the movement of the piston 24 once it has begun in response to movement of the handle 60. The pressure balances occurring within the first and second cavities, 81 and 82, move the piston into the proper position and maintain that position until a subsequent movement of the handle 60 and the rotary valve 30.

With continued reference to FIGS. 1 and 2A-2D, it can be seen that the hydraulic actuator comprises first 51, second 52, third 53, and fourth 54 ports. The first and second ports, 51 and 52, are connected to the first and second cavities, 81 and 82, of the hydraulic actuator 20, respectively. The third and fourth ports, 53 and 54, are physically disposed axially between the first and second ports, 51 and 52. Moving the rotary hydraulic valve 30 to a first position which connects the first and third ports, 51 and 53 to the reservoir 46, connects the second port to the hydraulic pump 40, and closes the fourth port 54, causes the hydraulic actuator 20 to move to the forward gear position illustrated in FIG. 2A. Moving the rotary hydraulic valve 30 to a second position which connects the second and fourth ports, 52 and 54, to the reservoir 46, connects the first port 51 to the hydraulic pump 40, and closes the third port 53 causes the hydraulic actuator 20 to move into the reverse gear position illustrated in FIG. 2C. The neutral gear position comprises a first neutral gear position, or forward-neutral gear position, shown in FIG. 2B and also comprises a second neutral gear position or reverse-neutral gear position shown in FIG. 2D. Moving the rotary hydraulic valve 30 to a third position which connects the third and fourth ports, 53 and 54, to the reservoir 46, connects the first port 51 to the hydraulic pump 40, and closes the second port 52 causes the hydraulic actuator 20 to move to the first neutral gear position or forward-neutral gear position illustrated in FIG. 2B. Moving the right rotary hydraulic valve 30 to a fourth position which connects the third and fourth ports, 53 and 54, to the reservoir 46, connects the second port 52 to the hydraulic pump 40, and closes the first port 51 causes the hydraulic actuator 20 to move into the second neutral gear position, or reverse-neutral gear position shown in FIG. 2D. The first and second neutral gear positions of the hydraulic actuator 20 are axially displaced from each other and are both between the forward and reverse gear positions shown in FIGS. 2A and 2C.

Figure 3B:
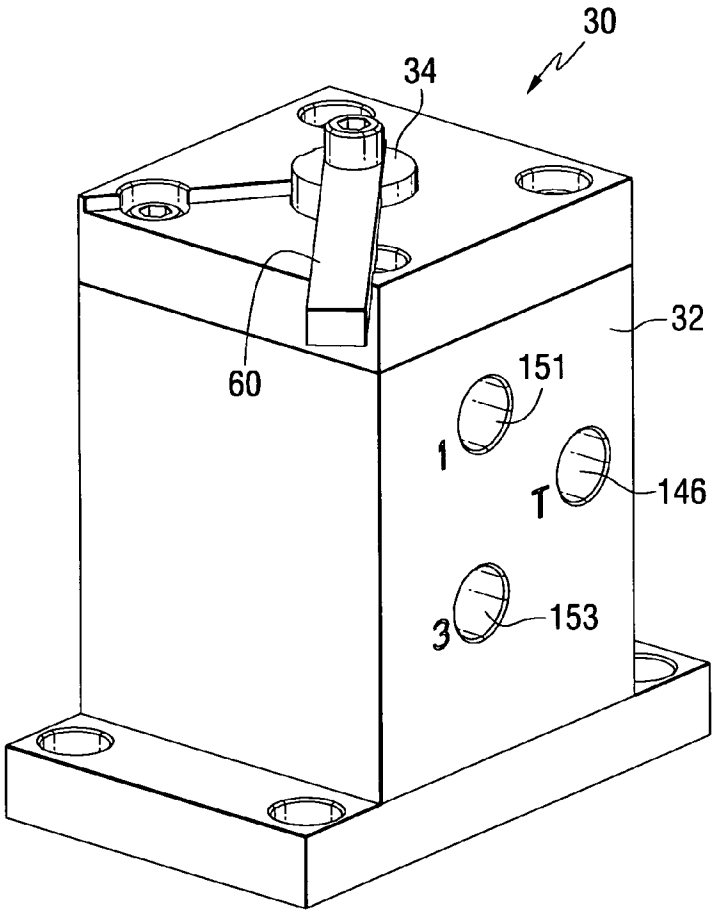
FIGS. 3A and 3B show two sides of an isometric representation of a rotary valve of the present invention.
Figure 3A:
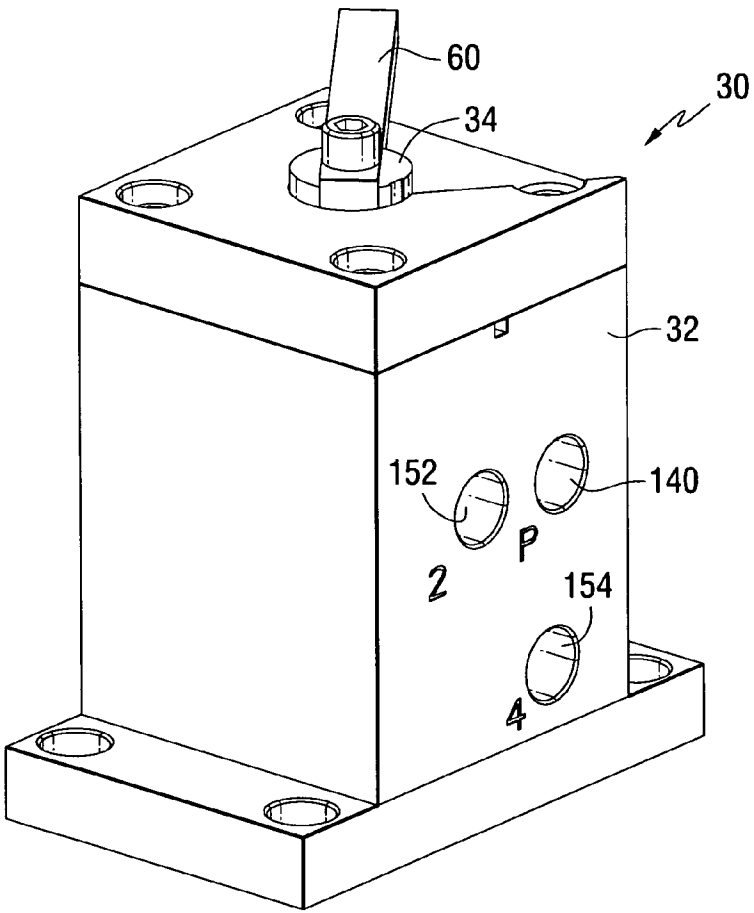

FIGS. 3A and 3B are isometric views of hypothetical rotary valve 30 with connection points for second and fourth ports, 152 and 154 and another 140 for the pump 40. FIG. 3B shows an opposite side of the valve 30 with a connection location 146 where a reservoir 46, or tank T, can be connected to the valve. In addition, connection points 151 and 153 show where conduits can be connected from the valve 30 to the first and third ports, 51 and 53, of the hydraulic actuator 20.

Figure 4A:
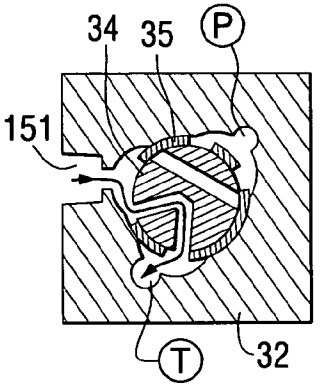
FIGS. 4A-4D show sections of a rotary valve moved into a position to result in a forward gear position.
Figure 4B:
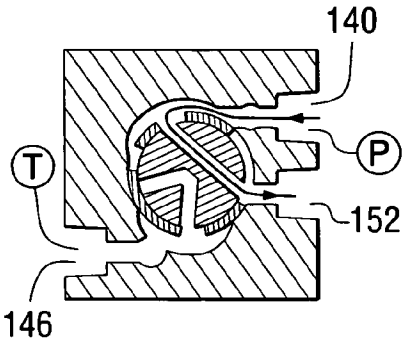
Figure 4C:
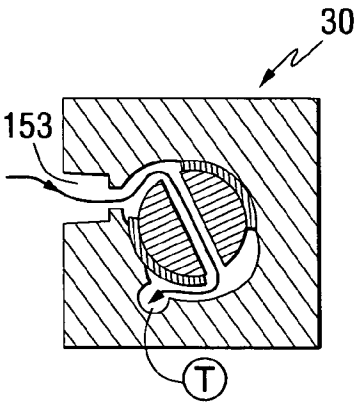
Figure 4D:
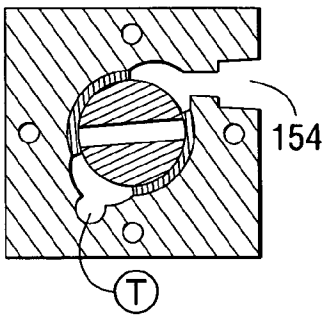

FIGS. 4A-4D show section views of the relative positions of the movable portion 34 and a stationary portion 32 of the rotary valve 30 when the handle 60 is in a position to command the forward gear position. The movable portion is divided into four stages that are axially displaced relative to each other, with each stage being separated from the other stages by an O-ring. A precision machined sleeve 35 is oriented relative to and fixed to the stationary portion 32. This sleeve 35 more precisely defines the conduits formed in the valve 30. This allows conduits formed through the movable portion, or rotary portion, to conduct hydraulic fluid between selected ports formed in the stationary portion. The section views of FIGS. 4A-4D show arrows to illustrate the resulting flow of hydraulic fluid. When in the forward gear position, the rotary valve 30 directs hydraulic fluid to flow from the first port 51 of the hydraulic actuator 20 through a channel formed in the movable portion 34 from connection point 151 to the reservoir 46 or tank T. The arrow in FIG. 4A represents this flow path. In FIG. 4B, it can be seen that hydraulic fluid is directed, by the second stage of the valve, from the pump P to the opening 152 which is a connection point to the second port 52 of the hydraulic actuator. Similarly, as illustrated in FIG. 4C, hydraulic fluid is directed from the third port 53 to connection point 153 and to the reservoir 46, or tank T. As shown in FIG. 4D, connection point 154, which is connected to the fourth port 54 of the hydraulic actuator 20, is closed. The position of the rotary valve represented in FIGS. 4A-4D result in the gear actuator being in the forward gear position.

Figure 5A:
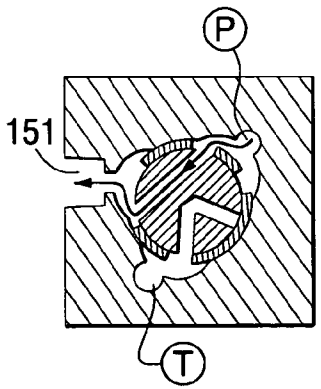
FIGS. 5A-5D show sections of the rotary valve moved into a position that results in a reverse gear position.
Figure 5B:
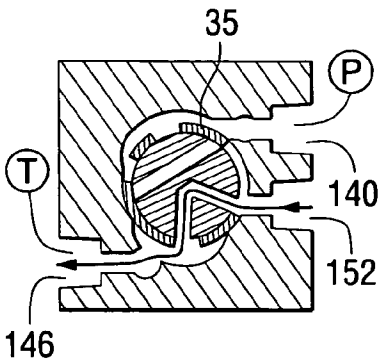
Figure 5C:
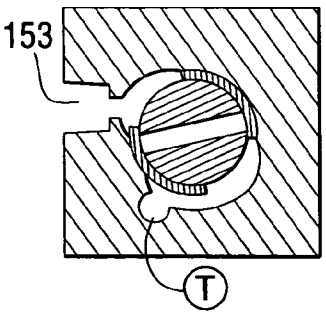
Figure 5D:
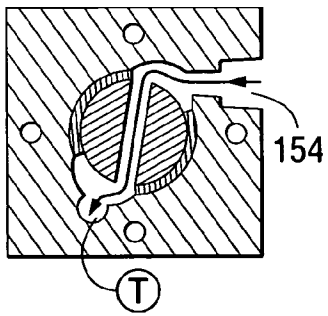

In the reverse gear position the positions shown in FIGS. 5A-5D are used. Pressure P is directed through the rotary portion of the valve toward connection point 151 and port 51 of the hydraulic actuator 20 in FIG. 5A. In FIG. 5B, it can be seen that port 52 is connected through connection point 152 to the tank T or reservoir 46. FIG. 5C shows that the third port 53 is closed. FIG. 5D shows a path provided from connection point 154, which is connected to the fourth port 54 of the hydraulic actuator 70, to the reservoir 46 or tank T. The positions represented in FIGS. 5A-5D show the rotary valve in a configuration that results in a reverse gear position of the hydraulic actuator and clutch.

Figure 6D:
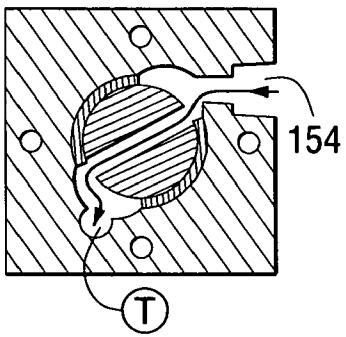
FIGS. 6A-6D show sections of the rotary valve moved into a forward-neutral gear position.
Figure 6C:
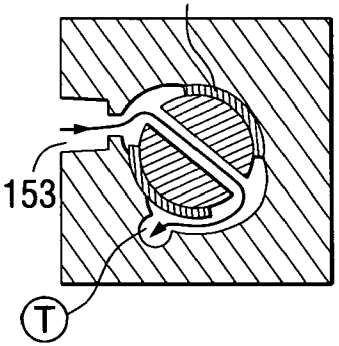
Figure 6B:
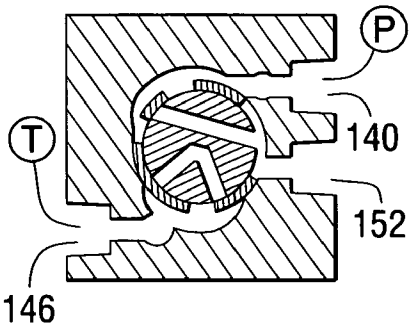
Figure 6A:
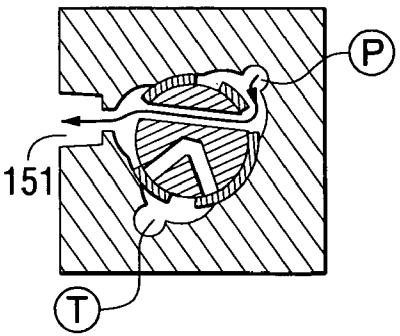

FIG. 6A shows the pressure from pump P directed to port 51 through connection point 151. FIG. 6B shows that connection point 152 to the second port 52 is blocked. FIG. 6C shows that a path is provided between connection point 153 of the third port 53 and the tank T, or reservoir 46. FIG. 6D shows that the connection point 154 to the fourth port 54 is connected to the reservoir 46, or tank T. The positions shown in FIGS. 6A-6D result in the clutch being placed in the forward-neutral gear position, or first neutral position described above.

Figure 7D:
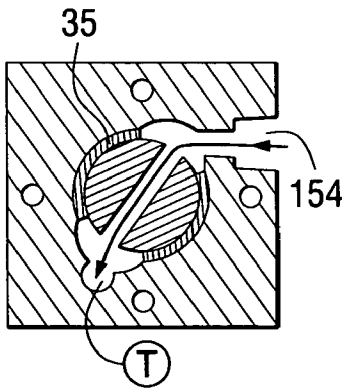
FIGS. 7A-7D show sections of a rotary valve moved into a position that results in a reverse-neutral gear position.
Figure 7C:
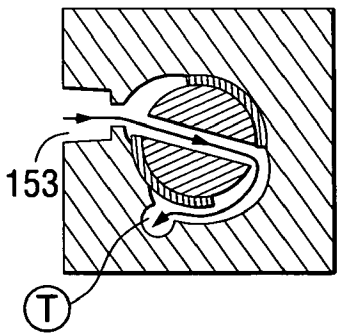
Figure 7B:
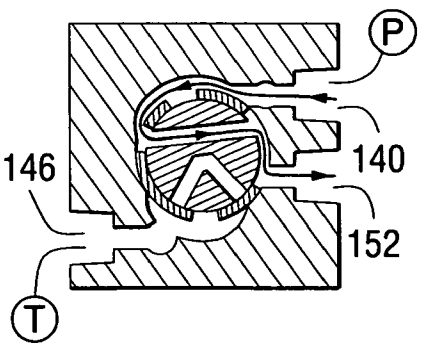
Figure 7A:
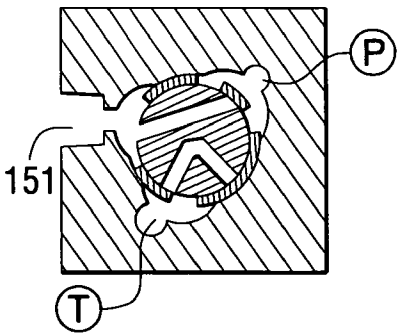

FIG. 7A shows that connection point 151 of the first port 51 is blocked. FIG. 7B shows pressure being directed from the pump P to connection point 152 of the second port 52. FIG. 7C shows the path from connection point 153 of the third port 53 to the tank T, or reservoir 46, and FIG. 7B shows that the connection point 154 of the fourth port 54 is similarly connected to the tank T, or reservoir 46. The positions shown in FIGS. 7A-7D result in the clutch being moved to the reverse-neutral, or second neutral, position described above.

With reference to FIGS. 1, 2A-2D, 3A-3B, 4A-4D, 5A-5D, 6A-6D, and 7A-7D, it can be seen that a preferred embodiment of the present invention provides a marine transmission actuator which comprises a propeller shaft 14 supported for rotation about a rotational axis 16, a clutch 10 which is movable in a direction parallel to the rotational axis 16 of the propeller shaft in the forward, neutral, and reverse gear positions, a hydraulic actuator 20 that is operatively connected to the clutch 10 and configured to selectively move the clutch into the gear positions, and a hydraulic valve 30 which has a stationary portion 32 and a movable portion 34. The hydraulic valve is configured to direct hydraulic fluid between first and second cavities, 81 and 82, of the hydraulic actuator 20, a hydraulic pump 40, and a reservoir 46. The hydraulic valve 30 is configured to cause the hydraulic actuator 20 to move to a selected gear position and remain in the selected gear position until subsequent movement of the hydraulic valve. In a preferred embodiment, the hydraulic valve 30 is a rotary valve and the movable portion 34 is rotatable relative to the stationary portion 32. The hydraulic actuator comprises first 51, second 52, third 53, and fourth 54 ports. The first and second ports are connected to the first and second cavities, 81 and 82, of the hydraulic actuator 20, respectively. The third and fourth ports, 53 and 54, are disposed axially between the first and second ports, 51 and 52. Moving the hydraulic valve 30 to a first position (FIGS. 4A-4D) which connects the first and third ports to the reservoir 46, connects the second port to the hydraulic pump 40, and closes the fourth port 54 causes the hydraulic actuator 20 to move to the forward gear position (FIG. 2A). Moving the hydraulic valve to a second position (FIGS. 5A-5D) which connects the second and fourth ports, 52 and 54, to the reservoir 46, connects the first port 51 to the hydraulic pump 40, and closes the third port 53 causes the hydraulic actuator to move to the reverse gear position FIG. 2C). The neutral gear position comprises first and second neutral gear positions in a preferred embodiment of the present invention. Moving the hydraulic valve to a third position (FIGS. 6A-6D) causes the hydraulic actuator to move to a first neutral gear position, or a forward-neutral gear position (FIG. 2B) and moving the hydraulic valve to a fourth position (FIGS. 7A-7D) causes the hydraulic actuator to move into a second neutral gear position, or reverse-neutral gear position (FIG. 2D).

Although the present invention has been described with particular specificity and illustrated to show a preferred embodiment, it should be understood that alternative embodiments are also within its scope.

We claim:

1. A marine transmission actuator, comprising:

a clutch which is movable into forward, neutral, and reverse gear positions;

a hydraulic actuator operatively connected to said clutch and configured to selectively move said clutch into said forward, neutral, and reverse gear positions; and a hydraulic valve having a stationary portion and a movable portion, said hydraulic valve being configured to direct hydraulic fluid between first and second cavities of said hydraulic actuator, a hydraulic pump, and a reservoir, said hydraulic valve being configured to cause said hydraulic actuator to move to a selected gear position and remain in said selected gear position until subsequent movement of said hydraulic valve, said clutch being a singular clutch movable to each of said forward, neutral, and reverse gear positions, said hydraulic actuator being a singular piston actuator, said piston being axially reciprocal along an axial travel stroke and having first and second axially facing distally opposite sides, said actuator having a first port communicating with said first side of said piston through said first cavity, said actuator having a second port communicating with said second side of said piston through said second cavity, said actuator having a third port axially between said first and second ports.

2. The marine transmission actuator of claim 1, wherein:

said hydraulic valve is a rotary valve, said movable portion being rotatable relative to said stationary portion.

3. The marine transmission actuator of claim 1, wherein:

said hydraulic actuator comprises first, second, third, and fourth ports;

said first and second ports are connected to said first and second cavities of said hydraulic actuator, respectively; and said third and fourth ports are disposed axially between said first and second ports.

4. The marine transmission actuator of claim 3, wherein:

moving said hydraulic valve to a first position which connects said first and third ports to said reservoir, connects said second port to said hydraulic pump, and closes said fourth port causes said hydraulic actuator to move to said forward gear position.

5. The marine transmission actuator of claim 3, wherein:

moving said hydraulic valve to a second position which connects said second and fourth ports to said reservoir, connects said first port to said hydraulic pump, and closes said third port causes said hydraulic actuator to move to said reverse gear position.

6. The marine transmission actuator of claim 3, wherein:

said neutral gear position comprises a first neutral gear position and a second neutral gear position.

7. The marine transmission actuator of claim 6, wherein:

moving said hydraulic valve to a third position which connects said third and fourth ports to said reservoir, connects said first port to said hydraulic pump, and closes said second port causes said hydraulic actuator to move to said first neutral gear position.

8. The marine transmission actuator of claim 6, wherein:

moving said hydraulic valve to a fourth position which connects said third and fourth ports to said reservoir, connects said second port to said hydraulic pump, and closes said first port causes said hydraulic actuator to move to said second neutral gear position.

9. The marine transmission actuator of claim 6, wherein:

said first and second neutral gear positions of said hydraulic actuator are axially displaced from each other and are both between said forward and reverse gear positions.

10. A marine transmission actuator, comprising:

a propeller shaft supported for rotation about a rotational axis;

a clutch which is movable, in a direction parallel to said rotational axis of said propeller shaft, into forward, neutral, and reverse gear positions;

a hydraulic actuator operatively connected to said clutch and configured to selectively move said clutch into said forward, neutral, and reverse gear positions; and a hydraulic valve having a stationary portion and a movable portion, said hydraulic valve being configured to direct hydraulic fluid between first and second cavities of said hydraulic actuator, a hydraulic pump, and a reservoir, said hydraulic valve being configured to cause said hydraulic actuator to move to a selected gear position and remain in said selected gear position until subsequent movement of said hydraulic valve, said clutch being a singular clutch movable to each of said forward, neutral, and reverse gear positions, said hydraulic actuator being a singular piston actuator, said piston being axially reciprocal along an axial travel stroke and having first and second axially facing distally opposite sides, said actuator having a first port communicating with said first side of said piston through said first cavity, said actuator having a second port communicating with said second side of said piston through said second cavity, said actuator having a third port axially between said first and second ports.

11. The marine transmission actuator of claim 10, wherein:

said hydraulic valve is a rotary valve, said movable portion being rotatable relative to said stationary portion.

12. The marine transmission actuator of claim 10, wherein:

said hydraulic actuator comprises first, second, third, and fourth ports;

said first and second ports are connected to said first and second cavities of said hydraulic actuator, respectively; and said third and fourth ports are disposed axially between said first and second ports.

13. The marine transmission actuator of claim 12, wherein:

moving said hydraulic valve to a first position which connects said first and third ports to said reservoir, connects said second port to said hydraulic pump, and closes said fourth port causes said hydraulic actuator to move to said forward gear position; and moving said hydraulic valve to a second position which connects said second and fourth ports to said reservoir, connects said first port to said hydraulic pump, and closes said third port causes said hydraulic actuator to move to said reverse gear position.

14. The marine transmission actuator of claim 13, wherein:

said neutral gear position comprises a first neutral gear position and a second neutral gear position.

15. The marine transmission actuator of claim 14, wherein:

moving said hydraulic valve to a third position which connects said third and fourth ports to said reservoir, connects said first port to said hydraulic pump, and closes said second port causes said hydraulic actuator to move to said first neutral gear position; and moving said hydraulic valve to a fourth position which connects said third and fourth ports to said reservoir, connects said second port to said hydraulic pump, and closes said first port causes said hydraulic actuator to move to said second neutral gear position.

16. The marine transmission actuator of claim 15, wherein:

said first and second neutral gear positions of said hydraulic actuator are axially displaced from each other and are both between said forward and reverse gear positions.

17. A marine transmission actuator, comprising:

a propeller shaft supported for rotation about a rotational axis;

a dog clutch which is movable, in a direction parallel to said rotational axis of said propeller shaft, into forward, neutral, and reverse gear positions;

a hydraulic actuator operatively connected to said dog clutch and configured to selectively move said dog clutch into said forward, neutral, and reverse gear positions; and a rotary hydraulic valve having a stationary portion and a movable portion, said rotary hydraulic valve being configured to direct hydraulic fluid between first and second cavities of said hydraulic actuator, a hydraulic pump, and a reservoir, said rotary hydraulic valve being configured to cause said hydraulic actuator to move to a selected gear position and remain in said selected gear position until subsequent movement of said rotary hydraulic valve, said clutch being a singular clutch movable to each of said forward, neutral, and reverse gear positions, said hydraulic actuator being a singular piston actuator, said piston being axially reciprocal along an axial travel stroke and having first and second axially facing distally opposite sides, said actuator having a first port communicating with said first side of said piston through said first cavity, said actuator having a second port communicating with said second side of said piston through said second cavity, said actuator having a third port axially between said first and second ports.

18. The marine transmission actuator of claim 17, wherein:

said hydraulic actuator comprises first, second, third, and fourth ports;

said first and second ports are connected to said first and second cavities of said hydraulic actuator, respectively;

said third and fourth ports are disposed axially between said first and second ports;

moving said rotary hydraulic valve to a first position which connects said first and third ports to said reservoir, connects said second port to said hydraulic pump, and closes said fourth port causes said hydraulic actuator to move to said forward gear position; and moving said rotary hydraulic valve to a second position which connects said second and fourth ports to said reservoir, connects said first port to said hydraulic pump, and closes said third port causes said hydraulic actuator to move to said reverse gear position.

19. The marine transmission actuator of claim 18, wherein:

said neutral gear position comprises a first neutral gear position and a second neutral gear position.

20. The marine transmission actuator of claim 19, wherein:

moving said rotary hydraulic valve to a third position which connects said third and fourth ports to said reservoir, connects said first port to said hydraulic pump, and closes said second port causes said hydraulic actuator to move to said first neutral gear position;

moving said rotary hydraulic valve to a fourth position which connects said third and fourth ports to said reservoir, connects said second port to said hydraulic pump, and closes said first port causes said hydraulic actuator to move to said second neutral gear position; and said first and second neutral gear positions of said hydraulic actuator are axially displaced from each other and are both between said forward and reverse gear positions.

* * * * *